US012279660B2

(12) United States Patent
Henderson

(10) Patent No.: US 12,279,660 B2
(45) Date of Patent: Apr. 22, 2025

(54) MOTORCYCLE FOREARM AND SHIN GLIDER

(71) Applicant: Kevin Leon Henderson, Downey, CA (US)

(72) Inventor: Kevin Leon Henderson, Downey, CA (US)

( * ) Notice: Subject to any disclaimer, the term of this patent is extended or adjusted under 35 U.S.C. 154(b) by 0 days.

(21) Appl. No.: 17/879,188

(22) Filed: Aug. 2, 2022

(65) Prior Publication Data

US 2022/0369731 A1 Nov. 24, 2022

Related U.S. Application Data

(63) Continuation-in-part of application No. 16/865,394, filed on May 3, 2020, now abandoned, which is a continuation-in-part of application No. 15/842,283, filed on Dec. 14, 2017, now abandoned.

(51) Int. Cl.
*A41D 13/05* (2006.01)

(52) U.S. Cl.
CPC .... *A41D 13/0543* (2013.01); *A41D 2600/102* (2013.01)

(58) Field of Classification Search
CPC .. A41D 13/0543; A41D 13/065; A41D 13/08; A41D 13/0156; A41D 13/05; A41D 13/055; A41D 13/0556; A41D 13/0562; A41D 13/0568; A41D 13/06; A41D 2600/102; A41D 2600/10
See application file for complete search history.

(56) References Cited

U.S. PATENT DOCUMENTS

| | | | | |
|---|---|---|---|---|
| 2,568,083 A | | 9/1951 | Mitchell | |
| 3,712,299 A | * | 1/1973 | Voehl | A41D 13/065 2/24 |
| 3,945,047 A | * | 3/1976 | Jarrell, Jr. | A63B 71/1225 2/24 |
| 5,423,087 A | | 6/1995 | Krent et al. | |
| 5,581,805 A | | 12/1996 | Rennick | |
| 5,594,954 A | | 1/1997 | Huang | |

(Continued)

FOREIGN PATENT DOCUMENTS

| | | | | |
|---|---|---|---|---|
| EP | 0455348 A1 | | 11/1991 | |
| EP | 3053462 A1 | | 8/2016 | |
| GB | 0455348 A1 | * | 6/1991 | A41D 13/06 |

*Primary Examiner* — Uyen T Nguyen

(74) *Attorney, Agent, or Firm* — McConnell Law Firm PC; Robert McConnell

(57) ABSTRACT

A forearm and shin glider for motorcycle cornering including a deformable base with slits that allow secure and comfortable fit to the rider's arm or leg. An abrasion resistant casing is attached to the base. This casing holds a set of abrasion resistant balls made of high speed smooth abrasion resistant ceramic. The abrasion resistant balls are located by bearings, also manufactured of ceramic. This device allows the rider to make contact with the ground for support during tight cornering maneuvers with substantially reduced and minimized friction. The abrasion resistant balls move smoothly within the bearings and casing and roll when contacting the ground, creating minimal friction but also providing substantial rider support. The glider device includes air ducts for air flow to reduce friction related heat. The glider device is attached to the rider's clothing using Velcro or hook and loop attachment devices.

8 Claims, 10 Drawing Sheets

(56) References Cited

U.S. PATENT DOCUMENTS

| | | | | |
|---|---|---|---|---|
| 5,794,275 | A * | 8/1998 | Donzis | A41D 31/28 2/24 |
| 5,870,774 | A | 2/1999 | Legenstein | |
| 5,937,440 | A | 8/1999 | Ferriter | |
| 6,510,560 | B1 * | 1/2003 | Ugolnik | A63C 17/04 2/22 |
| 7,891,018 | B2 | 2/2011 | Atkinson | |
| 7,992,219 | B2 | 8/2011 | Bay | |
| 9,095,179 | B2 | 8/2015 | Kwan et al. | |
| 9,555,311 | B1 * | 1/2017 | Mustafa | A41D 13/0005 |
| 2006/0137071 | A1 | 6/2006 | Rampersad | |
| 2006/0277642 | A1 | 12/2006 | Legenstein | |
| 2008/0289072 | A1 | 11/2008 | Shin | |
| 2009/0077703 | A1 * | 3/2009 | Gabry | A63B 71/12 2/22 |
| 2012/0131729 | A1 | 5/2012 | Hernandez | |
| 2014/0182041 | A1 | 7/2014 | Archuleta | |
| 2016/0021948 | A1 | 1/2016 | MacNeil | |
| 2016/0021954 | A1 * | 1/2016 | MacNeil | A41D 31/24 2/2.5 |
| 2017/0347742 | A1 * | 12/2017 | Turner | A41D 13/0587 |

* cited by examiner

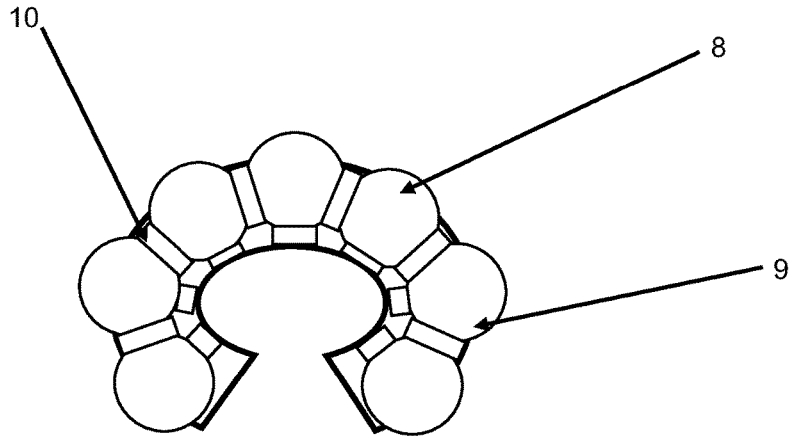
Fig. 12
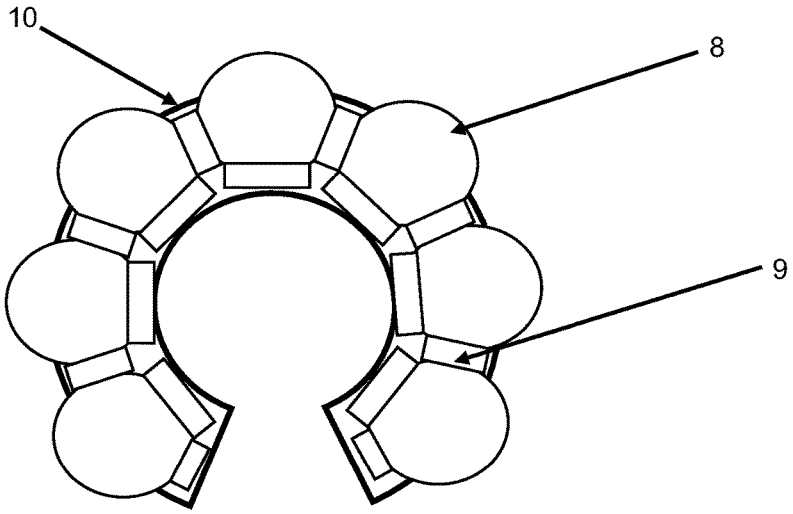

MOTORCYCLE FOREARM AND SHIN GLIDER

BACKGROUND OF THE INVENTION

Field of the Invention

The invention relates to a forearm and shin glider for use in motorcycling.

During fast cornering, riders of motorcycles and scooters, especially motorcycle racers, are forced to lean their motor vehicles in an inclined position as to safely corner at the highest speed possible.

Through continued developments in tire technology, it is possible in recent times to take greater lean angles resulting in much higher cornering speeds than previously possible. To achieve this, a cornering style has been developed which involves contact between the rider's forearm and knee with the road or ground surface on the inside of the corner or curve.

The motorcycle racer will thereby consciously seek contact with the ground or road to find the support necessary for top speed when corning during motor sports.

Existing protection devices currently are generally made of plastic molding. The use of these existing devices for high speed cornering is not optimal, because the friction generated between the plastic and road surface is substantial and the road contact acts as a brake during cornering and causes rider discomfort. To avoid this "stick-slip" effect, riders often avoid touching the ground.

Ground contact has a stabilizing effect, permitting better control of the motorcycle through the cornering maneuver. The present invention is designed to provide the necessary support while also reducing the "stick-slip" braking effect. The abrasion resistant bearing encased balls of the present invention allow riders to seek the support of the ground while cornering, but without the significant friction and performance reduction of prior art devices. Allowing the devices at both the forearm and shin provides the maximum cornering incline and grounds support. The abrasion resistant casing can withstand impact with the ground, but the deformable base with slits cut in it provide the rider with a secure fit around their arm or leg. The glider device can be attached with Velcro, hook and loop or other suitable attachment methods.

DESCRIPTION OF BACKGROUND ART

Prior art devices include slider pads for motorcycling that include a variety of configurations of slider pads. These devices all utilize pads that create substantial friction when making contact with the ground.

Other prior art devices include a variety of clothing items with built in padding and sliders but these devices have the same friction issue described above and solved by the present invention.

Other variations of prior art devices include knee rollers designed for use while working on the ground (on one's knees) rather than riding a motorcycle. These do include rollers, but not rollers designed for high speed low friction operation and not substantially wear resistant for durability when making contact with the ground at high speed.

Objects of the Invention

It is an object of the invention to provide a motorcycle glider for the shin and forearm.

It is an object of the invention to provide a motorcycle glider that provides support during high speed cornering with a minimum of friction.

It is an object of the invention to provide a motorcycle glider that provides improved support during cornering and improved rider comfort.

It is an object of the invention to provide a motorcycle glider with improved durability.

It is an object of the invention to provide a motorcycle glider with improved rider fit.

It is an object of the invention to provide a motorcycle glider with multiple attachment means to the rider's clothing.

It is an object of the invention to provide a motorcycle glider with cooling ducts built in the structure.

SUMMARY OF THE INVENTION

The present invention relates to motorcycling and devices that facilitate high speed cornering for motorcycle riders, particularly in motorcycle racing. Motorcycle riders lean into turns while cornering with increasing lean angles dependent on the speed and radius of the corner. Improved tire compounds allow increased cornering angles for riders. Riders typically provide support during cornering by dropping their knees and forearms to the ground. Prior art pads exist to protect riders during these cornering maneuvers but have the significant drawback of substantial friction between the ground and the pad. This friction slows the rider, impacts the cornering geometry and creates rider discomfort.

The present invention seeks to solve these problems by providing a forearm and shin glider for motorcycle cornering. The claimed invention includes a deformable base with slits that allow secure and comfortable fit to the rider's arm or leg. A deformable casing is attached to the base. This casing holds a set of abrasion resistant balls made of high speed smooth abrasion resistant ceramic. The abrasion resistant balls are located by bearings, also manufactured of ceramic. The bearings are located by an abrasion resistant ring. This device allows the rider to make contact with the ground for support during tight cornering maneuvers with substantially reduced and minimized friction. The abrasion resistant balls move smoothly within the bearings and casing and roll when contacting the ground, creating minimal friction but also providing substantial rider support. The base also includes air ducts to provide cooling air to the device as heat from friction builds up. The glider device is attached to the rider's clothing using Velcro or hook and loop attachment devices. The preferred embodiment also includes a locating wire to provide additional grip and support to the device as it's worn around the rider's leg or arm.

BRIEF DESCRIPTION OF THE DRAWINGS

FIG. 12 shows a cross section of the glider in various formations with the casing removed.

DESCRIPTION OF THE PREFERRED EMBODIMENT

The following detailed description outlines the preferred embodiment of the claimed invention. There may be many other configurations that comport with the attached claim language and this description is in no way limiting to the scope of the invention.

Figure 1:
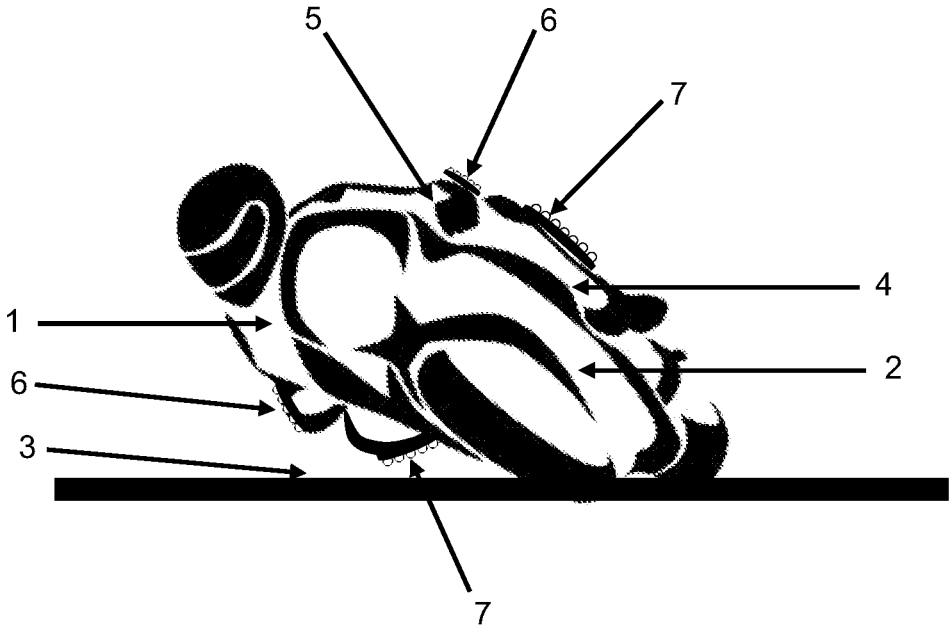
FIG. 1 shows a view of a motorcyclist cornering at a significant lean angle.

FIG. 1 shows an image of a motorcycle rider leaning into a turn at a significant angle. In this figure, rider 1 is located on motorcycle 2 traveling over road surface 3. The rider's leg 4 and arm 5 are visible in the figure. Forearm glider 6 is attached to the rider's clothing at their arm 5 and shin glider 7 is attached to the rider's clothing between their knee and shin to protect leg 4. In this figure, forearm glider 6 and shin glider 7 will contact road surface 3 to provide support for rider 1 as they corner their motorcycle at high speed. While the preferred embodiment shows motorcycle 2, the present invention is suitable for use for any two wheeled vehicle where support of the shin and forearm would be helpful during cornering like scooters, etc.

Figure 2:
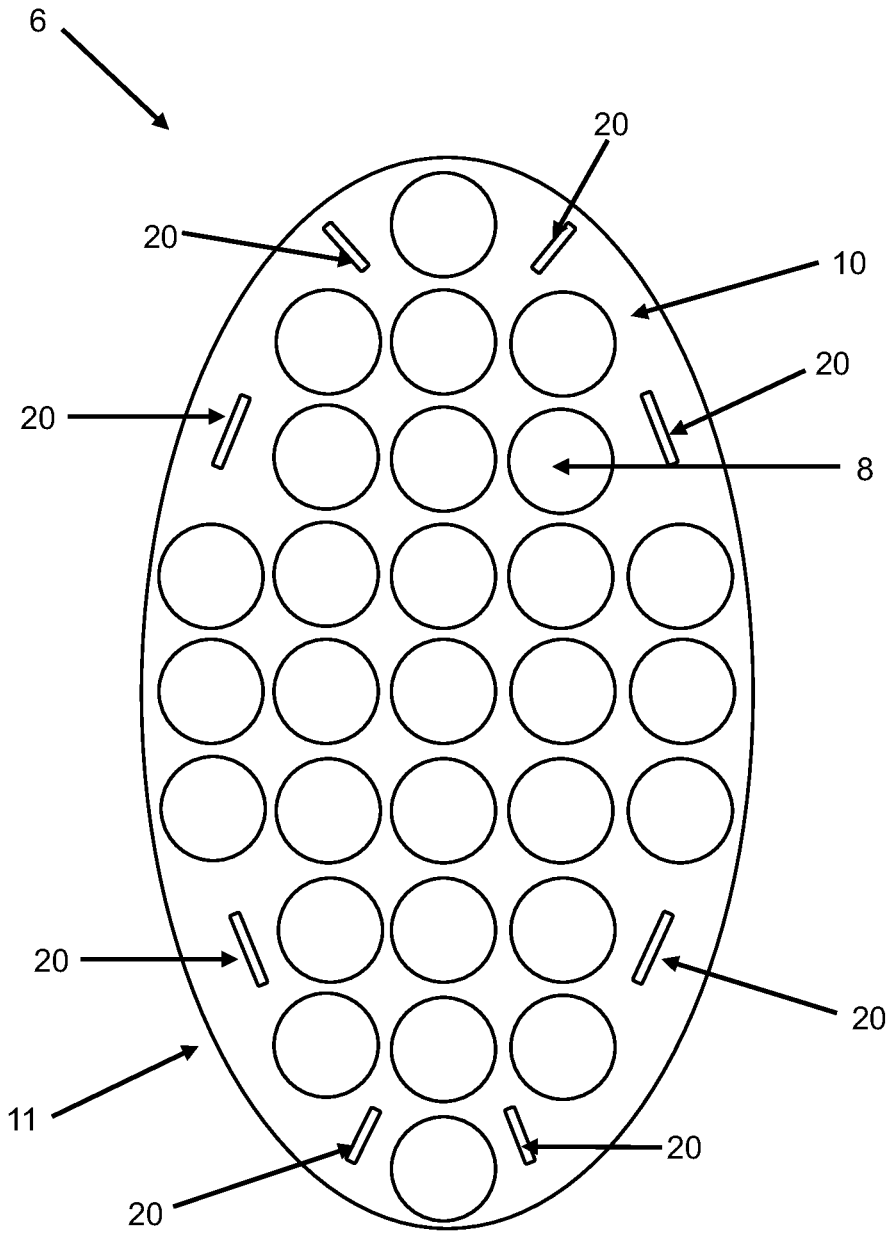
FIG. 2 shows a view of the glider device with the casing in place.

FIG. 2 shows the road contact side of forearm glider 6. Forearm glider 6 and shin glider 7 have similar compositions and structures so while forearm glider 6 is described in detail, the description applies to shin glider 7 as well. Abrasion resistant balls 8 contact the road surface 3 (not shown in this figure) to provide support but also roll to avoid friction that slows the rider or pulls the rider toward the ground or into the turn. Prior art motorcycle sliders create significant friction and thus slow the rider or change the cornering geometry in a negative way. In the preferred embodiment, abrasion resistant balls 8 are made of high speed wear resistant smooth ceramic. This material provides wear resistance, durability and low friction, however many other suitable materials could be used like wear resistant, durable plastics and various metals, like high carbon steel and stainless steel. Glider casing 10 is deformable so that it can bend when the glider is bent around the rider's leg or arm. In the preferred embodiment, casing 10 is made of rubber but could be made out of other suitable materials such as flexible plastic, various flexible metals or other flexible and deformable materials. Attachment device 11 in the preferred embodiment would be Velcro attached to the rider's clothing at the suitable location. Other suitable attachment methods include hook and loop fasteners known in the art or zippers, snaps and buttons. Vertical air ducts 20 are shown in various locations around the road contact side of forearm glider 6. These ducts are used to cool the device while in use by the rider. Even with the reduced friction of the present invention, heat will build up as the rider makes contact with the road surface. Vertical air ducts 20 connect to horizontal air ducts 21 (shown in later figures) to provide cooling air flow through the device to reduce heat build up due to friction.

Figure 3:
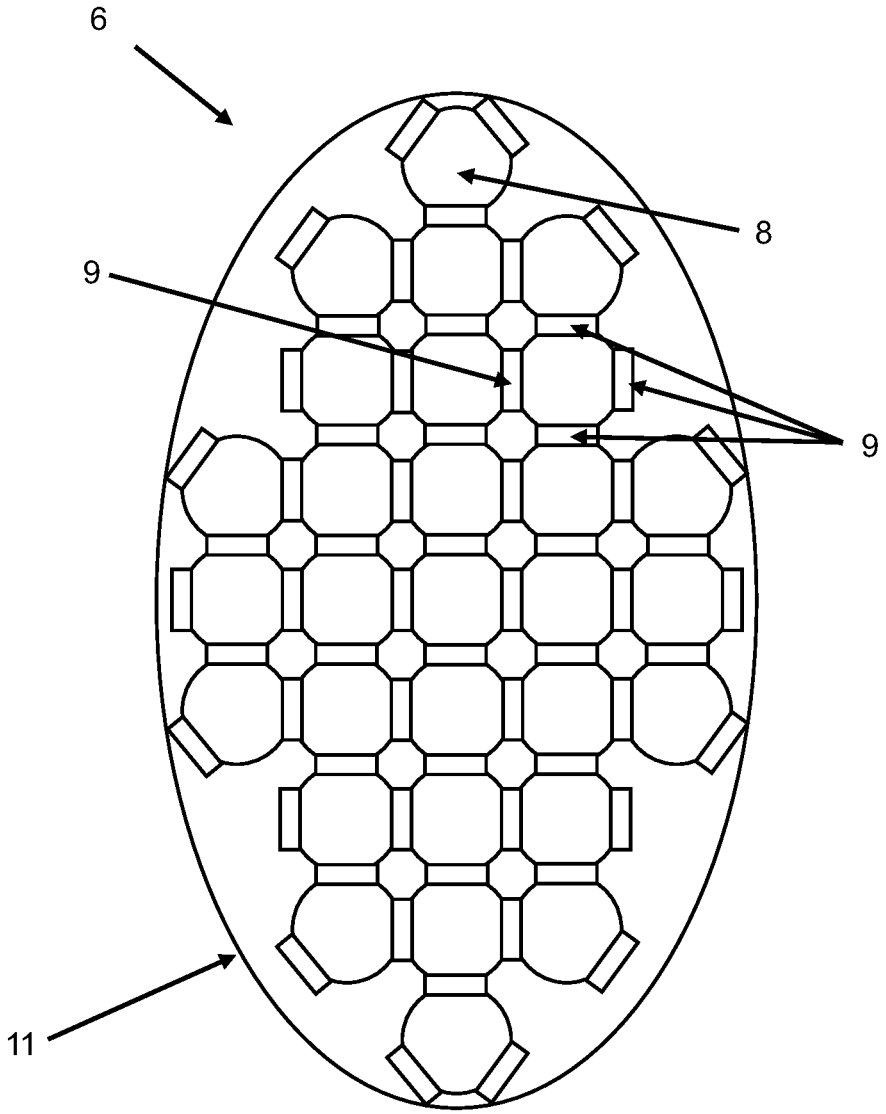
FIG. 3 shows a view of the glider device with the casing removed and the bearings visible.

FIG. 3 shows the road contact side of the forearm glider 6 with casing 10 removed. In this view, abrasion resistant ball 8, made of ceramic materials, is located by bearing 9 on the top, bottom and both sides. Bearings 9 are also manufactured out of high speed wear resistant smooth ceramic. These bearings rotate on their axis to allow abrasion resistant ball 8 to rotate quickly with a minimum of friction. Bearings 9 also locate abrasion resistant ball 8 so each stays in place during the stress of high speed cornering where the ball 8 comes into contact with road surface 3. Attachment device 11 is also shown in this view.

Figure 4:
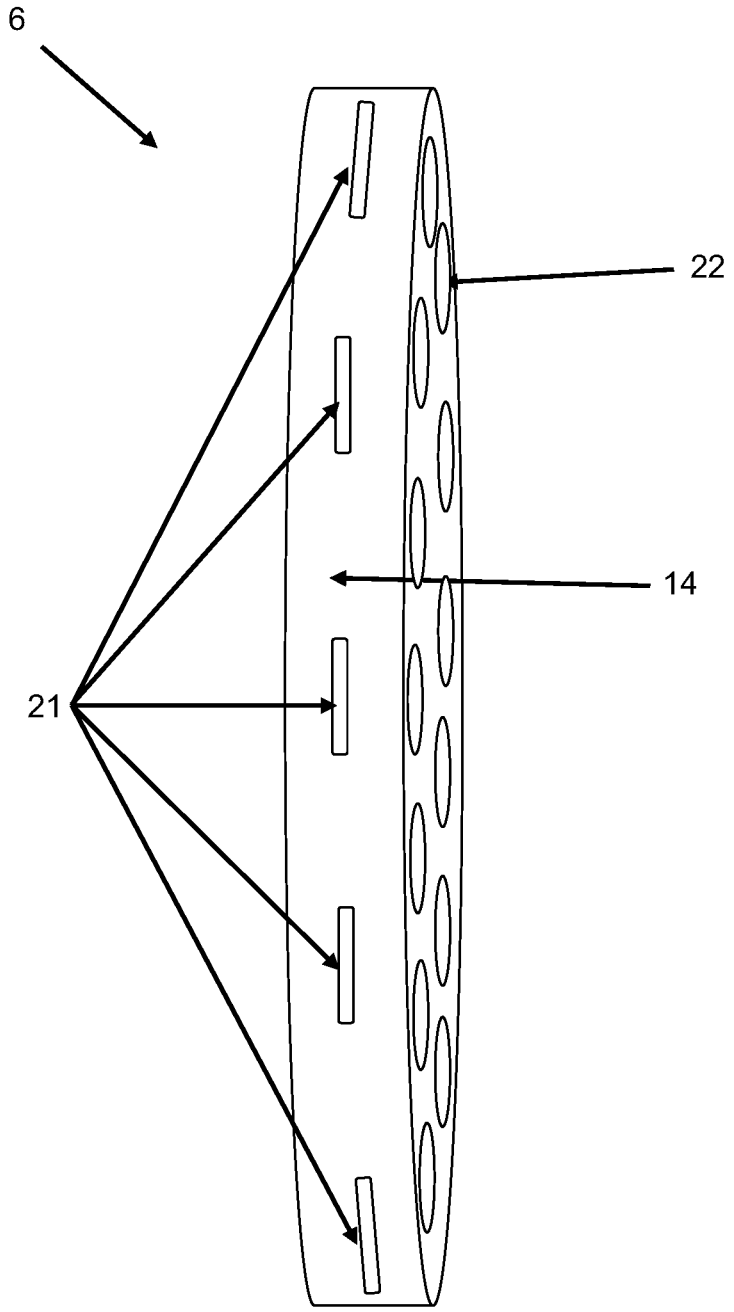
FIG. 4 shows a side view of the casing with air ducts shown.

FIG. 4 shows a side view of forearm glider 6 with base 14 in place. Base 14 is made out of a deformable material that can be molded to the user's leg or arm, in the preferred embodiment hard rubber. This deformable material also provides better user comfort. Horizontal air ducts 21 are also shown formed in the side of base 14. These horizontal air ducts 21 connect to vertical air ducts 20 and provide cooling air flow through glider 6. In the preferred embodiment, horizontal air ducts 21 connect to vertical air ducts 20, but any suitable configuration may be used. The air flow through horizontal air ducts 21 and vertical air ducts 20 provide cooling to reduce the buildup of heat due to friction when the device contacts the road surface.

Figure 5:
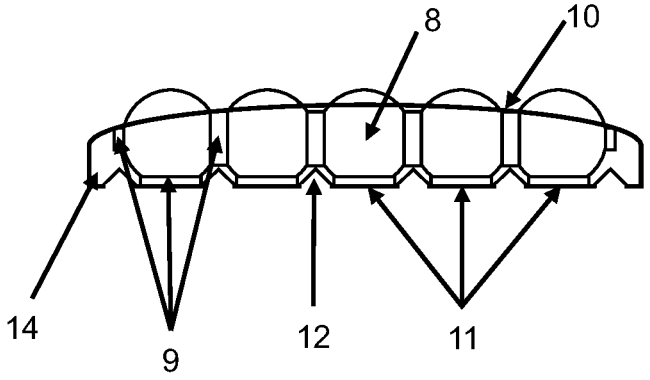
FIG. 5 shows a side view of the glider with the casing removed.

FIG. 5 shows a lateral side view cutaway view of forearm glider 6. Abrasion resistant ball 8 is shown located by bearings 9. As previously discussed, in the preferred embodiment, these items are made of high speed wear resistant smooth ceramic. Casing 10 is shown as is attachment device 11. Slit 12 are cuts in the material that allow the unit to be deformed to fit securely around the rider's arm or leg. When these slits collapse, it allows the device to fit the curve of the user's extremity. The slits can be made in any formation, but in the preferred embodiment they are formed vertically. Base 14 is made out of a deformable material that can be molded to the user's leg or arm, in the preferred embodiment hard rubber. This deformable material also provides better user comfort.

In the preferred embodiment, casing 10 is attached to base 14 using either adhesive known in the art or stitching. Another possible method for attaching casing 10 to base 14 is using clips that snap in place in a matching location in the base to securely attach the two items. The clip mechanism also allows the user to replace the casing as it becomes worn and to inspect, clean and replace the abrasion resistant balls 8 or bearings 9.

Figure 6:
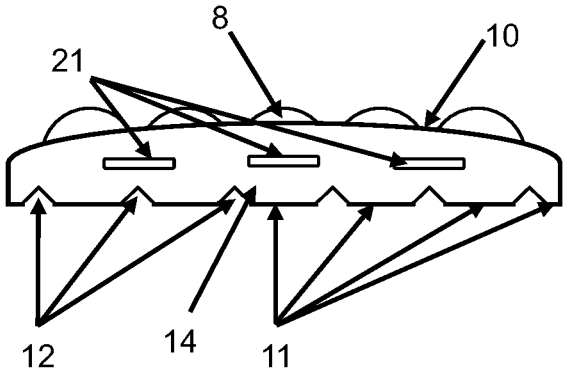
FIG. 6 shows a side view of the glider with the casing in place.

FIG. 6 shows a side view of the forearm glider 6 with casing 10 in place around the device. In this view, the slits 12 are visible in their open position, prior to having the device installed on the rider's leg or arm. Base 14 is made of a deformable material, in the preferred embodiment, hard rubber to enable the user to mold the device to their extremity, either arm or leg. Installation device 11 is also shown. Horizontal air ducts 21 are also shown. Horizontal air ducts 21 provide air flow through the device to vertical air ducts 20 reducing heat buildup due to friction of the device contacting the pavement.

Figure 7:
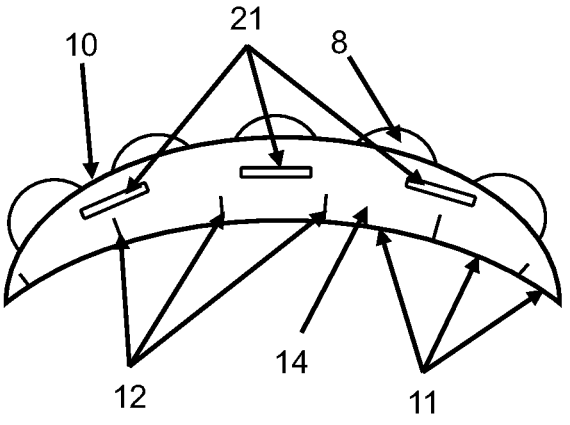
FIG. 7 shows a side view of the glider with the slits closed to show deformability.

FIG. 7 shows the glider 6 bent in an arc with slits 12 closed so that the device can be molded to the rider's arm or leg. Horizontal air ducts 21 are also shown. Horizontal air ducts 21 provide air flow through the device to vertical air ducts 20 reducing heat buildup due to friction of the device contacting the pavement.

Figure 8:
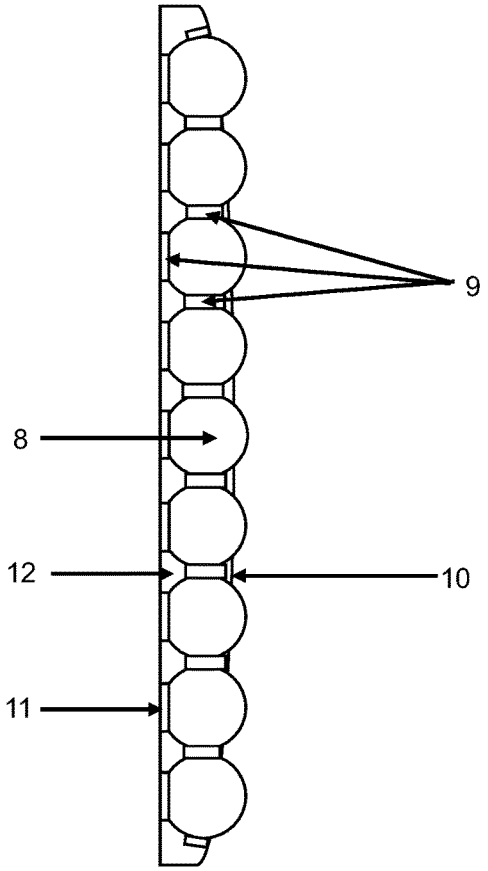
FIG. 8 shows a vertical side view of the glider with the casing removed.
Figure 9:
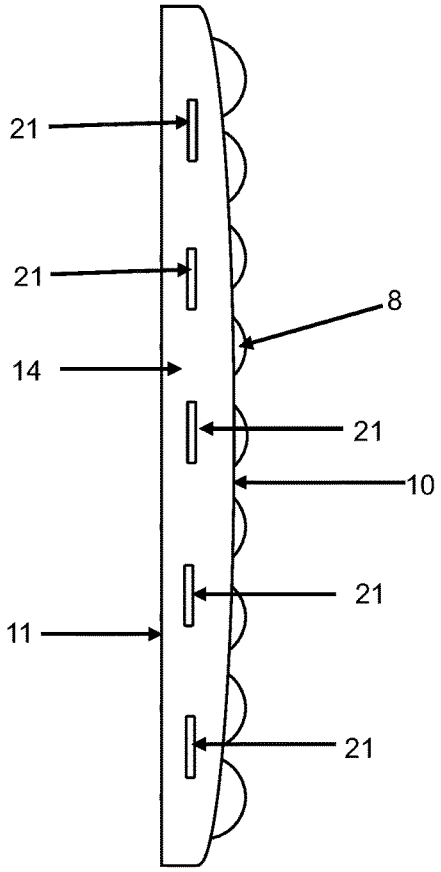
FIG. 9 shows a vertical side view of the glider with the casing in place.

FIGS. 8 and 9 show vertical views of the glider device. In cutaway view FIG. 7, abrasion resistant ball 8 is located by bearings 9. This installation allows the abrasion resistant ball to rotate with a minimum of friction but also to be firmly installed in the device. In the preferred embodiment, abrasion resistant balls 8 and bearings 9 are made of high speed wear resistant ceramic. Casing 10 is shown in both figures, as is slit 12 and base 14. In FIG. 9, horizontal air ducts 21 are shown. Horizontal air ducts 21 provide air flow through the device to vertical air ducts 20 reducing heat buildup due to friction of the device contacting the pavement.

Figure 10:
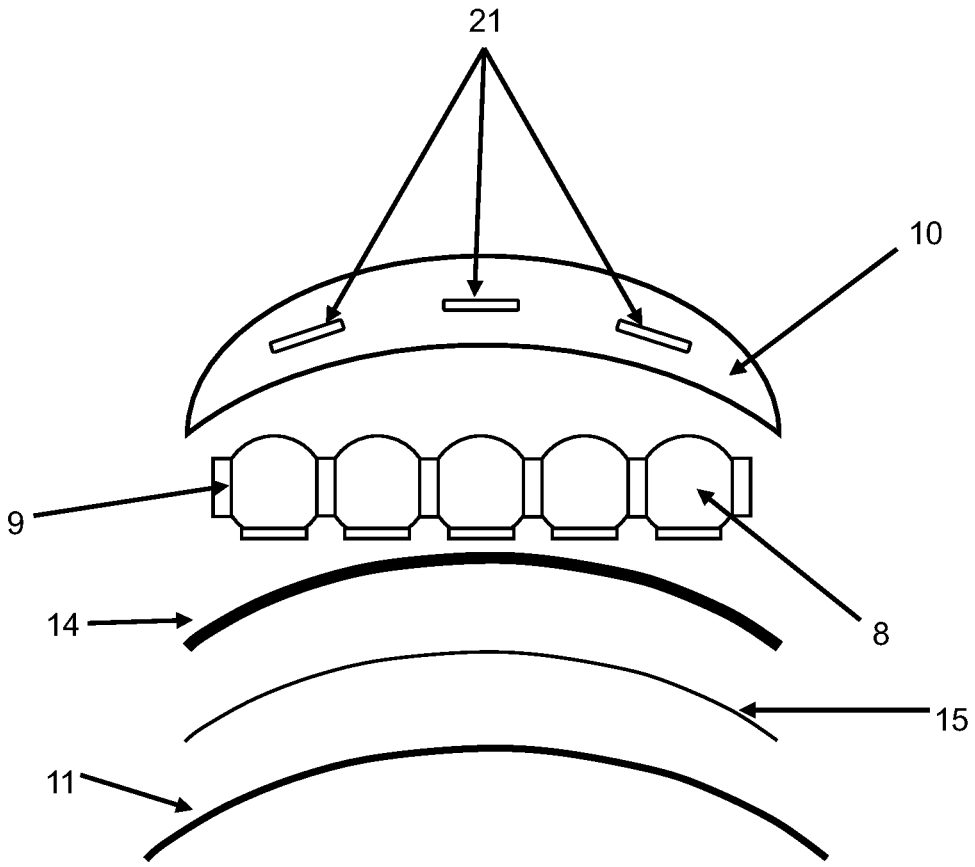
FIG. 10 shows a cross section exploded view of the glider.

FIG. 10 shows a cross section of layers for an alternate preferred embodiment. Casing 10 is made of a deformable material that encloses abrasion resistant balls 8 and bearings 9. Both abrasion resistant balls 8 and bearings 9 are made of high speed wear resistant smooth ceramic but could be made of other suitable low friction, wear resistant materials such as various metals including stainless steel, titanium and others. Base 14 is also made of a deformable material such as rubber that allows it to be formed around the arm or leg of the rider. Other deformable materials could also be used such as flexible plastic. Locating wire 15 is a thin wire made of bendable metal. This wire will be built into the base 14 to provide additional grip and support for the device around the rider's arm or leg. The locating wire 15 will run horizontally across the glider so that it can be wrapped around the circumference of the rider's arm or leg. The rider will simply wrap the device around their arm or leg and locating wire 15 will form a contour to match the shape of the arm or leg and provide support for the device in that shape. Installation device 11 is shown as a layer here and is made of Velcro in the preferred embodiment. This layer attaches the device to the rider's clothing. The combination of locating wire 15 and installation device 11 provide secure attachment and support for the device as the user wears it and as it contacts the ground during cornering. Horizontal air ducts 21 are also shown. Horizontal air ducts 21 provide air flow through the device to vertical air ducts 20 reducing heat buildup due to the friction of device contacting the pavement.

Figure 11:
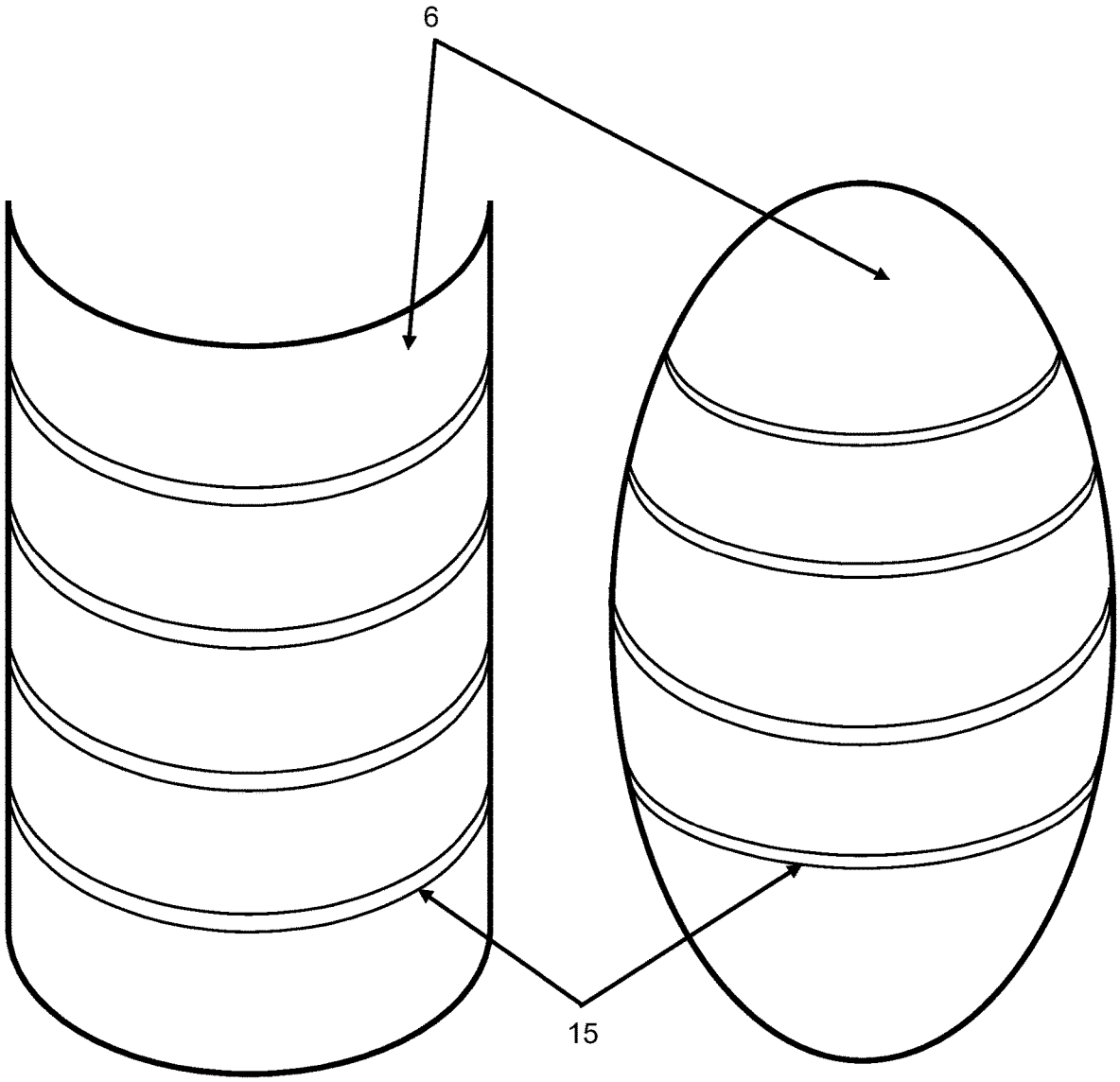
FIG. 11 shows curved and flattened views of the glider and the locating wire.
Figure 11:
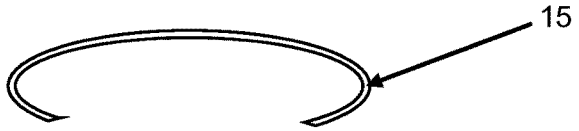

FIG. 11 shows a view of the glider 6 and locating wire 15 with the glider 6 flat or bend in a semi-circle to be wrapped around the rider's arm or leg. FIG. 10 additionally shows locating wire removed from the glider device. Locating wire 15 is manufactured from high tensile steel in the preferred embodiment but can be manufactured out of any suitable flexible and high strength metal such as stainless steel, titanium or other suitable materials such as flexible plastic, well known in the art.

FIG. 12 provides a cross section view of glider 6 with it formed in various semi-circle formations to be worn around the rider's arm or leg. In this view, the deformable casing 10 is removed, abrasion resistant balls 8 and bearing 9 are all visible.

Figure 13:
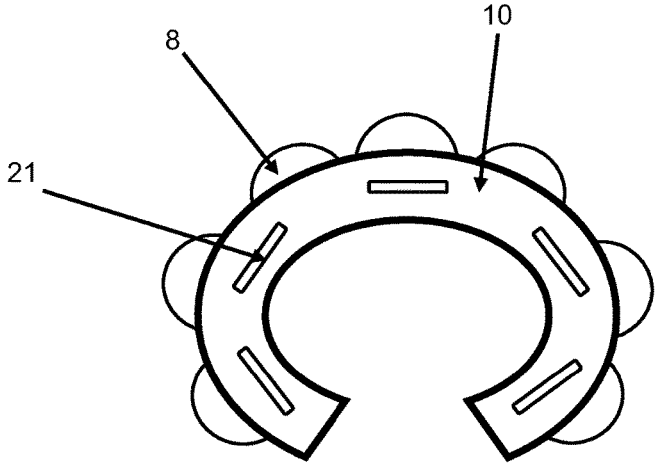
FIG. 13 shows the glider in various formations with the casing in place.
Figure 13:
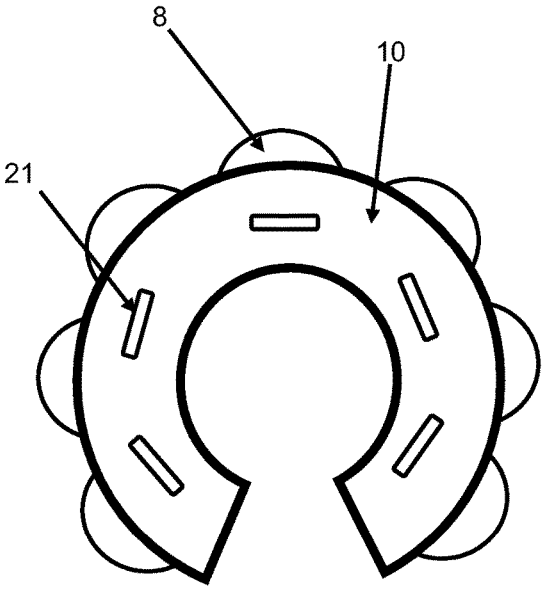

FIG. 13 shows the same view as FIG. 11 but with casing 10 in place and covering the glider 6. In this view, horizontal air ducts 21 are also shown. Horizontal air ducts 21 provide air flow through the device to vertical air ducts 20 reducing heat buildup due to the friction of the device contacting the pavement.

The present figures display the preferred embodiment of the claimed invention and are not meant to limit the scope of the claims. Many other configurations and embodiments are possible within the scope of the present claims.

The invention claimed is:

1. A glider device for use by a motorcyclist rider for providing support while cornering a motorcycle comprising;

a first glider configured to be located at the rider's shin below the rider's knee comprising:

a first set of abrasion resistant balls, a first casing for holding said first set of abrasion resistant balls, a first set of low friction bearings that firmly hold each of the first set of abrasion resistant balls within the first casing and allow free rolling of the first set of abrasion resistant balls with low resistance, a first base, configured to be located at the rider's shin below the knee, the first casing attached to the first base, the first base formed of a deformable material, the deformable material having an interior side configured to be located proximately to the rider, an exterior side that is configured to be located away from the rider and at least one vertical wall formed between the interior side and the exterior side, the first base further having a first set of slits cut in the deformable material to allow the first base to form securely around the rider's shin and knee, the first set of slits being formed on the interior side of the deformable material of the first base, the first base further comprising a first set of air ducts that provides air flow through the first base, the first set of air ducts comprised of at least one interior side air duct opening formed on the interior side of the first base and at least one vertical wall air duct opening formed on the vertical wall of the first base and fully surrounded by the deformable material of the first base, where the at least one interior side air duct opening and the at least one vertical wall air duct opening are connected such that air flows between them, and means for attaching the first glider to the motorcyclist's clothing, the first glider providing support and low friction, free movement and free rolling when the rider's knee and shin engages the ground, a second glider configured to be located at the rider's forearm comprising:

a second set of abrasion resistant balls, a second casing for holding said second set of abrasion resistant balls, a second set of low friction bearings that firmly hold each of the second set of abrasion resistant balls within the second casing and allow free rolling of the second set of abrasion resistant balls with low resistance, a second base, configured to be located at the rider's forearm, the second casing attached to the second base, the second base formed of the deformable material, the deformable material of the second base having an interior side configured to be located proximately to the rider, an exterior side that is configured to be located away from the rider and at least one vertical wall formed between the interior side of the second base and the exterior side of the second base, the second base further having a second set of slits cut in the deformable material to allow the second base to form securely around the rider's forearm, the second set of slits being formed on the interior side of the second base of the deformable material, the second base further comprising a second set of air ducts that provide air flow through the second base, the second set of air ducts comprised of at least one interior side air duct opening formed on the interior side of the second base and at least one vertical wall air duct opening formed on the vertical wall of the second base and fully surrounded by the deformable material of the second base, where the at least one interior side air duct opening of the second base and the at least one vertical wall air duct opening of the second base are connected such that air flows between them, and means for attaching the second glider to the motorcyclist's clothing, said second glider providing support and low friction, free movement and free rolling when the rider's forearm engages the ground.

2. The glider device of claim 1 where the first set of abrasion resistant balls, the second set of abrasion resistant balls, the first set of low friction bearings, and the second set of low friction bearings are made from ceramic material.

3. The glider device of claim 1 where the first casing and second casing are deformable.

4. The glider device of claim 1 where the first casing and second casing are formed of rubber.

5. The glider device of claim 1 where the first base and second base are formed of rubber.

6. The glider device of claim 1 where the first base and second base contain locating wires.

7. The glider device of claim 6 where the locating wires are formed of high tensile steel.

8. The glider device of claim 1, where the means for attaching the first glider and the second glider is a hook fastener secured to the back of the first glider and the second glider that is configured to connect to an associated loop on the motorcyclist's clothing.

* * * * *